US009546020B2

(12) United States Patent
Hsiao et al.

(10) Patent No.: US 9,546,020 B2
(45) Date of Patent: Jan. 17, 2017

(54) COMPOSITE PALLET

(71) Applicant: Shenzhen China Star Optoelectronics Technology Co., Ltd., Shenzhen, Guangdong (CN)

(72) Inventors: Yuchun Hsiao, Guangdong (CN); Qinjun Shi, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 151 days.

(21) Appl. No.: 14/426,741

(22) PCT Filed: Nov. 7, 2014

(86) PCT No.: PCT/CN2014/090617

§ 371 (c)(1),
(2) Date: Mar. 7, 2015

(87) PCT Pub. No.: WO2016/070422

PCT Pub. Date: May 12, 2016

(65) Prior Publication Data

US 2016/0332773 A1 Nov. 17, 2016

(30) Foreign Application Priority Data

Nov. 4, 2014 (CN) ..... 2014 1 0614800

(51) Int. Cl.

| | |
|---|---|
| ***B65D 19/38*** | (2006.01) |
| ***B65D 19/00*** | (2006.01) |
| ***B65D 85/48*** | (2006.01) |

(52) U.S. Cl.

CPC ..... *B65D 19/0095* (2013.01); *B65D 19/38* (2013.01); *B65D 85/48* (2013.01);
(Continued)

(58) Field of Classification Search

CPC ..... B65D 19/00; B65D 2519/00547
(Continued)

(56) References Cited

U.S. PATENT DOCUMENTS 2,405,535 A * 8/1946 Weiss ..... B65D 19/38 108/54.1
2,643,081 A * 6/1953 Spring ..... B65D 19/0093 108/54.1

(Continued)

*Primary Examiner* — Jose V Chen
(74) *Attorney, Agent, or Firm* — Andrew C. Cheng

(57) ABSTRACT

A composite pallet includes two parallel bottom block components each including a first bottom block and a second bottom block slidably connected, the first bottom block is capable of sliding relative to the second bottom block to vary the length. The composite pallet further includes two cantilever components each including a first cantilever and a second cantilever slidably connected, the first cantilever and the second cantilever each are fixed to a corresponding one of the bottom block components, the first cantilever being capable of sliding relative to the second cantilever along a lengthwise direction of the cantilever components to vary the length of the cantilever components. A crossed beam component includes a first beam and a second beam pivotably connected at a middle portion, free ends of both the first beam and the second beam are pivotally connected to free ends of the bottom block components.

14 Claims, 4 Drawing Sheets

(52) U.S. Cl.
CPC ..... *B65D 2519/00273* (2013.01); *B65D 2519/00308* (2013.01); *B65D 2519/00323* (2013.01); *B65D 2519/00333* (2013.01)

(58) Field of Classification Search
USPC ..... 108/51.11, 54.1, 56.1
See application file for complete search history.

(56) References Cited

U.S. PATENT DOCUMENTS 2,739,776 A * 3/1956 Terando ..... B65D 19/0002 108/54.1
2,764,377 A * 9/1956 Schoenecker ..... B65D 19/0095 108/54.1
2,828,931 A * 4/1958 Harvey ..... B65D 19/0095 108/54.1
2,909,350 A * 10/1959 Morris ..... B65D 19/0097 108/54.1
3,107,635 A * 10/1963 Kaiser ..... B65D 19/40 108/54.1
3,176,632 A * 4/1965 Yingling ..... B65D 19/42 108/54.1
3,225,938 A * 12/1965 Von Bromssen ..... A47J 45/10 211/85
3,267,884 A * 8/1966 Lessheim ..... B65D 19/0069 108/54.1
3,342,146 A * 9/1967 Lessheim ..... B65D 19/0012 108/53.3
3,695,187 A * 10/1972 Weiss ..... B65D 19/0095 108/54.1
3,858,723 A * 1/1975 Weiss ..... B65D 19/44 108/54.1
3,977,333 A * 8/1976 Phillips ..... B65D 19/0073 108/54.1
5,231,934 A * 8/1993 Good ..... B65D 19/38 108/54.1
6,776,382 B1 * 8/2004 Papadopoulos ..... B65D 57/00 108/54.1

* cited by examiner

COMPOSITE PALLET

BACKGROUND OF THE INVENTION

1. Field of the Invention

The present invention relates to a composite pallet.

2. Description of Related Art

To facilitate the placing of scattered items and shipping requirements, usually a special design of base structure is used in a pallet. In the existing liquid crystal display (LCD) modules and LCD glass packaging industries, a type of plastic pallet is usually used, which is made according to a specific size for adaptation of length and width dimensions of outer packing boxes for LCD modules or LCD glasses. However, when considering the matching and reliability of stacked pallets, different sizes of pallets need to be used to match the outer packing boxes. Thus, moldings of different dimensions should be designed to form the pallets of different dimensions when the dimensions of the outer packing boxes are different, and this makes it is difficult to save the cost of moldings and efficiently using of pallets in the practical scenes.

SUMMARY

Based upon the disadvantages of the existing art, embodiments of the present invention provide a composite pallet having adjustable dimensions, which meets the dimension requirements of various pallets for various outer packing boxes.

To achieve the above object, embodiments of the present invention provide the following technical solutions.

A composite pallet includes two parallel bottom block components, each of the bottom block components includes a first bottom block and a second bottom block slidably connected with the first bottom block, the first bottom block is capable of sliding relative to the second bottom block to vary the length of the bottom block components.

The composite pallet further includes two cantilever components, each of the two cantilever components includes a first cantilever and a second cantilever slidably connected with the first cantilever, the first cantilever and the second cantilever are fixed to a corresponding one of the bottom block components, the first cantilever being capable of sliding relative to the second cantilever along a lengthwise direction of the cantilever components to vary the length of the cantilever components.

According to another aspect, the composite pallet further includes a crossed beam component, which includes a middle hinge shaft, a first beam and a second beam, the first beam and the second beam are pivotably connected at a middle portion with each other by the hinge shaft; an end hinge shaft is disposed on free ends of both the first beam and the second beam, the end hinge shaft pivotally connects the first beam and the second beam to free ends of the bottom block components.

According to another aspect, the composite pallet further at least two crossed beam components, each of the crossed beam components includes a middle hinge shaft, a first beam and a second beam, the first beam and the second beam are pivotably connected at a middle portion with each other by the hinge shaft; two adjacent crossed beam components are pivotably connected with each other by a hinge shaft disposed on end portions of the first beam and the second beam; a groove extends along a lengthwise direction of the bottom block components is formed in a top surface of the bottom block components; the hinge shaft extending into the groove; end hinge shafts are disposed on free ends of both the first beam and the second beam in crossed beam components at two opposite sides of the composite pallet, the end hinge shaft pivotally connects the first beam and the second beam to free ends of the bottom block components.

According to another aspect, the composite pallet further includes a middle bottom block of a hollow structure, a connected long groove and a plurality of third through holes are formed in a top surface of the middle bottom block, a bottom end of the middle hinge shaft is a stub caption, the middle hinge shaft is capable of sliding in the long groove after the bottom end of the middle hinge shaft passing through the third through holes.

According to another aspect, one of the first cantilever and the second cantilever includes a sliding pillar protruded from thereof, and the another one of the first cantilever and the second cantilever defines a bar-shaped opening extending along the lengthwise direction of the cantilevers and a first through hole in the middle of the bar-shaped opening, a stub end of the sliding pillar has a diameter less than that of the first through hole and greater than the width of the bar-shaped opening, the sliding pillar is capable of sliding in the bar-shaped opening after being inserted into the first through hole.

According to another aspect, each of the bottom block components includes one first bottom block, end portions of the first bottom block in the two bottom block components are fixed to two ends of one of the cantilever components, respectively, end portions of the second bottom block in the two bottom block components are fixed to two ends of another one of the cantilever components.

According to another aspect, each of the bottom block components comprises two first bottom blocks disposed at two opposite ends of a corresponding second bottom block; two ends of the cantilever components are fixed to end portions of said two first bottom blocks, respectively.

According to another aspect, the second bottom block has a hollow cylindrical structure and the first bottom blocks are inserted into the second bottom block.

According to another aspect, at least one sidewall of the first bottom block includes an elastic protrusion, and at least one sidewall of the second bottom block includes a latching hole for latching the elastic protrusion.

According to another aspect, the first bottom block is a hollow structure, and includes an elastic plate and a second through hole for allowing the elastic protrusion to pass through; one end of the elastic plate is fixed on an inner wall of the first bottom block, the elastic protrusion being formed on a free end of the elastic plate.

Embodiments of the present invention provide a composite pallet having adjustable dimensions, which meets the dimension requirements of various pallets for various outer packing boxes and improves the utilizing rate of pallets.

DETAILED DESCRIPTION OF PREFERRED EMBODIMENTS

A composite pallet includes two parallel bottom block components, and each of the two parallel bottom block components includes a first bottom block and a second bottom block sildably connected with each other. The first bottom block is capable of sliding relative to the second bottom block to adjust the length of the bottom block components.

To make the object, technical solutions and advantages of the present invention more clearly, the present invention is described in detail accompanying with the figures. It is to be understood that the embodiments described here are only used to interpret the present invention, and are not used to limit the present invention.

<Embedment 1>

The present embodiment provides a composite pallet which is capable of adjusting its dimensions at the lengthwise and width direction to match outer packing boxes of different dimensions. The pallet reduces unnecessary cost of developing molds and improves the utilizing rate of pallets.

Figure 1:
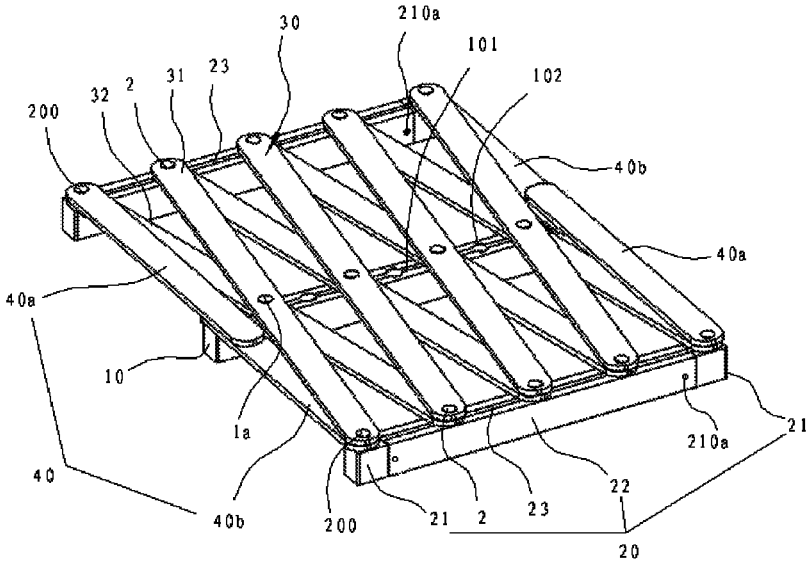
FIG. 1 is a schematic view illustrating a first state of a composite pallet provided by the embodiment 1.
Figure 2:
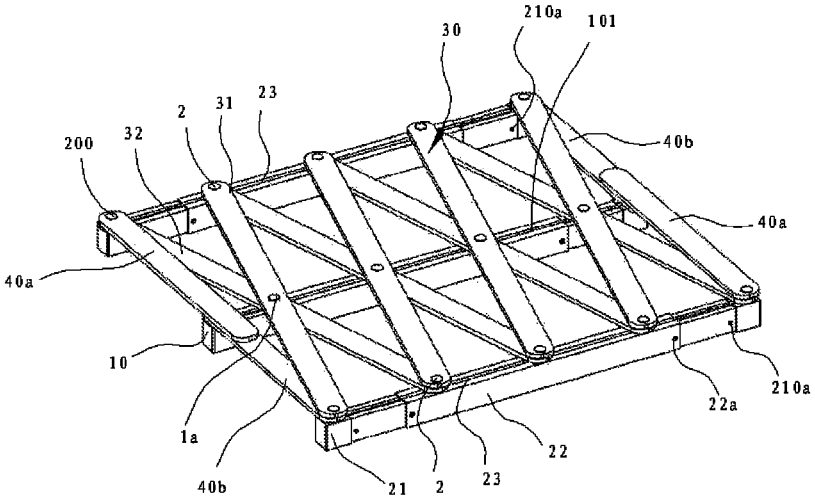
FIG. 2 is a schematic view illustrating a second state of the composite pallet provided by the embodiment 1.

FIGS. 1 and 2 are schematic views of an expanded state and a folded state of composite pallet provided by the embodiment 1, respectively. The composite pallet includes two parallel bottom block components 20 and two cantilevers 40. Each of the two bottom block components 20 includes a first bottom block 21 and a second bottom block 22. The first bottom block 21 is capable of sliding relative to the second bottom block 22 to change the length of the bottom block components 20. Each of the cantilevers 40 has the same structure and includes a first cantilever 40*a* and a second cantilever 40*b* slidably connected with each other. The first cantilever 40*a* and the second cantilever 40*b* are fixed to a corresponding bottom block component 20 using an end hinge shaft 200, respectively. The first cantilever 40*a* is capable of sliding along the lengthwise direction of the cantilevers 40 to change the length of the cantilevers 40.

Figure 3:
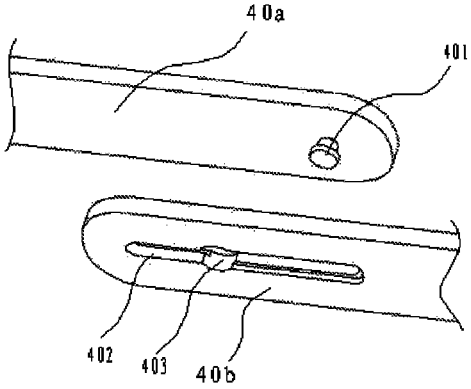
FIG. 3 is a schematic view illustrating a connection structure of cantilever of the composite pallet provided by the embodiment 1.

As shown in FIG. 3, in each of the cantilevers 40, one of the first cantilever 40*a* and the second cantilever 40*b* has a sliding pillar 401 protruded from thereof, and the another one of the first cantilever 40*a* and the second cantilever 40*b* defines a bar-shaped opening 402 extending along the lengthwise direction of the cantilevers 40 and a first through hole 403 in the middle of the bar-shaped opening 402. A stub end of the sliding pillar 401 has a diameter less than that of the first through hole 403 and greater than the width of the bar-shaped opening 402. The sliding pillar 401 is capable of sliding in the bar-shaped opening 402 after being inserted into the first through hole 403. In the present embodiment, the sliding pillar 401 is disposed on the first cantilever 40*a*, and the bar-shaped opening 402 and the first through hole 403 are formed in the second cantilever 40*b*.

By arranging a sliding connection between the first bottom block 21 and the second bottom block 22 in the bottom block components 20, the ability of adjusting the length of the pallet is achieved. By disposing two retractable cantilevers 40 between the two bottom block components 20, the ability of adjusting the width of the pallet is achieved. That is, the pallet is capable of adjusting both the length and width. This configuration can meet the requirements of placing packing boxes of different dimensions, and the utilizing rate of the pallet is improved.

In the present embodiment, each of the bottom block components 20 includes two first bottom blocks 21 and one second bottom block 22. The two first bottom blocks 21 are disposed at two opposite ends of the second bottom block 22, respectively. Two opposite ends of the cantilevers 40 are fixed on an end portion of the two first bottom blocks 21, respectively. To achieve the sliding movement of the two first bottom blocks 21 relative to the second bottom block 22, the second bottom block 22 of the present embodiment is formed as a hollow cylindrical structure. The first bottom block 21 is disposed within the second bottom block 22. It is to be understood that the sliding movement of the first bottom block 21 relative to the second bottom block 22 can also be achieved in other manners according to other embodiments.

Figure 4:
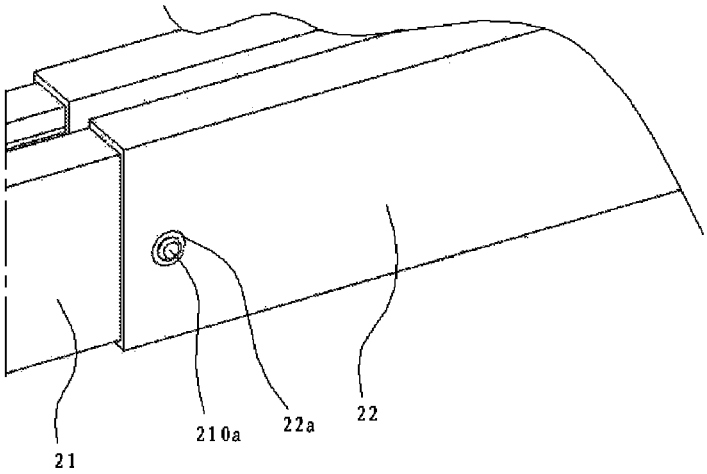
FIG. 4 is a schematic view illustrating a connection structure of bottom block of the composite pallet provided by the embodiment 1.

Referring to FIG. 4, to achieve locking of the pallet at both the expanded state and the retracted state, an elastic protrusion 210*a* is disposed on at least one sidewall of the first bottom blocks 21, and a latching hole 22*a* is formed in at least one sidewall of the second bottom block 22. The latching hole 22*a* is configured for latching the elastic protrusion 210*a*. During the sliding movement of the first bottom block 21 relative to the second bottom block 22, the elastic protrusion 210*a* is selectively latched into or rejected from the latching hole 22*a*. Accordingly, the length of the bottom block components 20 can be reliably switched to two different states. Specifically, two end portions of each first bottom block 21 have an elastic protrusion 210*a*. Correspondingly, two end portions of each second bottom block 22 have a latching hole 22*a*.

Figure 5:
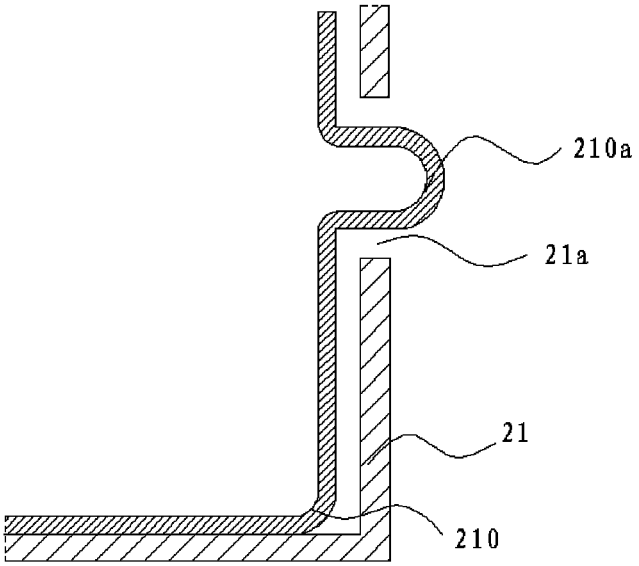
FIG. 5 is a partially enlarged view of a first bottom block of the composite pallet provide by the embodiment 1.

Specifically, the first bottom block 21 has a hollow structure. As shown in FIG. 5, the first bottom block 21 includes an elastic plate 210 and a second through hole 21*a* for allowing the elastic protrusion 210*a* passing through. An end of the elastic plate 210 is fixed on an inner wall of the first bottom block 21 using welding or other methods. The elastic protrusion 210*a* is formed on a free end of the elastic plate 210*a* to provide elastic restoring force for the elastic protrusion 210*a*.

To improve the continuity and operability of adjusting the length and width, the pallet of the present embodiment may further include at least two crossed beam components 30. Each of the crossed beam components 30 has an X-like shape, and includes a middle hinge shaft la, a first beam 31 and a second beam 32. The first beam 31 and the second beam 32 are pivotably connected with each other at the middle using the middle hinge shaft la. Two adjacent crossed beam components 30 are pivotably connected using a hinge shaft 2 disposed at end portions of the first beam 31 and the second beam 32. A groove 23 extending along the lengthwise direction of the bottom block components 20 is formed in a top surface of the bottom block components 20. That is, the groove 23 is formed in both the top surfaces of the first blocks 21 and the second bottom block 22. The hinge shaft 2 extends into the groove 23. Free ends of the first beam 31 and the second beam 32 of the crossed beam components at two opposite ends of the pallet are pivotably connected with the end hinge shaft 200, and therefore the first beam 31 and the second beam 32 are pivotally connected to free ends of the bottom block components.

Specifically, after being connected together, free ends of the two outermost crossed beam components 30 are fixed on end portions of two first bottom blocks 21, respectively. Thus, the crossed beam components 30 would drive the first bottom block 21 to slide relative to the second bottom block 22 when the crossed beam components 30 is transformed. Accordingly, the length of the bottom block components 20 can be adjusted.

The multiple connected crossed beam components form a structure that is capable of varying its length and width. In a practical application, the operator only needs to push the two bottom block components 20 to the middle to increasing the length of the pallet. Then, the pallet becomes longer and narrower. The crossed beam components 30 are transformed. At the same time, the overlapping portions of the first cantilever 40*a* and the second cantilever 40*b* increases, the first bottom block 21 extends from the second bottom block 22. As such, the length and width of the pallet is adjusted simultaneously. Similarly, when the width of the pallet needs to be increased, the operator only needs to stretch the two bottom block components 20 outwards to adjust the length and width of the pallet simultaneously.

In addition, the pallet of the present embodiment is comprised of a plastic material, which is very convenient form the pallet using a molding process. The composite pallet may further include a middle bottom block 10. The middle bottom block 10 has a hollow structure, and can provide supporting force for the crossed beam components 30. The middle bottom block 10 has the same structure to the bottom block components 20 at the two sides. Moreover, a long groove 101 and a plurality of third through holes 102, which are spaced apart from each other, are formed in a top surface of the middle bottom block 10. A bottom end of the middle hinge shaft 1*a* is a stub cap portion. The middle hinge shaft 1*a* can slide in the long groove 101 after the bottom end of the middle hinge shaft la is inserted into the long groove from the third through hole 102.

<Embodiment 2>

Figure 6:
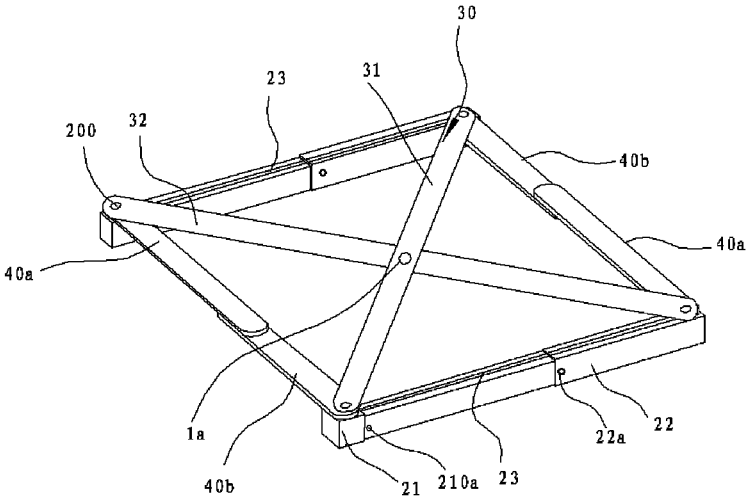
FIG. 6 is a schematic view illustrating a second state of a composite pallet provided by the embodiment 2.

FIG. 6 is a schematic view of retracting state of a composite pallet provided in the present embodiment. Differing from the embodiment 1, the pallet of the present embodiment only includes one crossed beam component 30. The crossed beam component 30 includes a middle hinge shaft la, a first beam 31 and a second beam 32. The first beam 31 and the second beam 32 are pivotably connected with each other at the middle using the middle hinge shaft 1*a*. Free ends of the first beam 31 and the second beam 32 all have an end hinge shaft 200. The end hinge shaft 200 is configured for pivotally connecting to free ends of the first bottom blocks 21 and the second bottom block 22.

<Embodiment 3>

Figure 7:
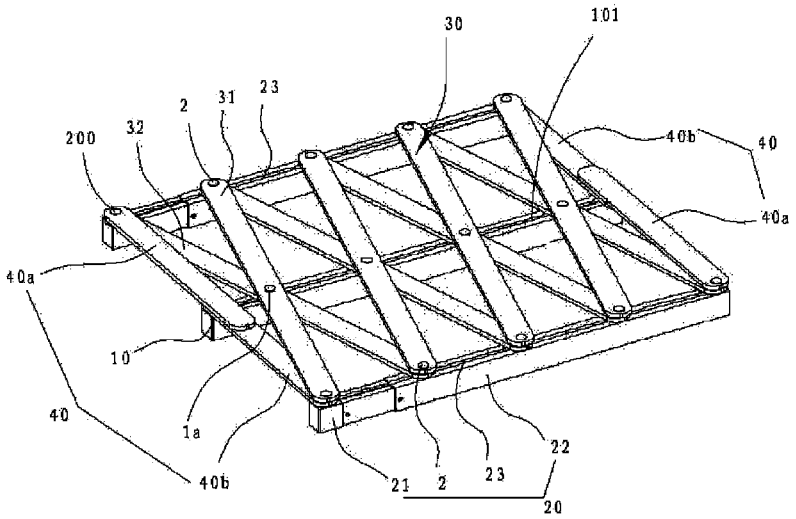
FIG. 7 is a schematic view illustrating a second state of a composite pallet provided by the embodiment 3.

FIG. 7 is a schematic view of retracting state of a composite pallet provided in the present embodiment. Differing from the embodiment 1, the pallet of the present embodiment only includes one first bottom block 21. Two ends of one of the cantilever components 40 are fixed on end portions of the first bottom blocks 21 at two opposite sides of the pallet, respectively, and two ends of another of the cantilever components 40 are fixed on end portions of the second bottom blocks at two opposite sides of the pallet. In the pallet of the present embodiment, after the crossed beam components 30 are connected together, free ends of the two outermost crossed beam components 30 are fixed on end portions of the first bottom block 21 and the second bottom block 22, respectively. Then, the crossed beam components 30 would drive the first bottom block 21 to move relative the second bottom block when the crossed beam components 30 are transformed. As a result, the length of the bottom block components 20 is adjusted.

Embodiments of the present invention provide a pallet capable of adjusting length and width thereof in a certain range, thus improve versatility of pallets and reduce the cost of developing molds. The above description is only several embodiments of the present application. It is to be noted that those ordinarily skilled in the art would make improvements and modifications to these embodiments without departing from the principle of the present application, and these improvements and modifications should also be included in the scope of the present application.

What is claimed is:

1. A composite pallet comprising:

two parallel bottom block components, each of the bottom block components comprising a first bottom block and a second bottom block slidably connected with the first bottom block, the first bottom block being capable of sliding relative to the second bottom block to vary the length of the bottom block components;

two cantilever components, each of the two cantilever components comprising a first cantilever and a second cantilever slidably connected with the first cantilever, the first cantilever and the second cantilever each being fixed to a corresponding one of the bottom block components, the first cantilever being capable of sliding relative to the second cantilever along a lengthwise direction of the cantilever components to vary the length of the cantilever components;

a crossed beam component, comprising a middle hinge shaft, a first beam and a second beam, the first beam and the second beam being pivotably connected at a middle portion with each other by the hinge shaft; an end hinge shaft being disposed on free ends of both the first beam and the second beam, the end hinge shaft pivotally connecting the first beam and the second beam to free ends of the bottom block components.

2. A composite pallet comprising:

two parallel bottom block components, each of the bottom block components comprising a first bottom block and a second bottom block slidably connected with the first bottom block, the first bottom block being capable of sliding relative to the second bottom block to vary the length of the bottom block components;

two cantilever components, each of the two cantilever components comprising a first cantilever and a second cantilever slidably connected with the first cantilever, the first cantilever and the second cantilever being fixed to a corresponding one of the bottom block components, the first cantilever being capable of sliding relative to the second cantilever along a lengthwise direction of the cantilever components to vary the length of the cantilever components;

at least two crossed beam components, each of the crossed beam components a middle hinge shaft, a first beam and a second beam, the first beam and the second beam being pivotably connected at a middle portion with each other by the hinge shaft; two adjacent crossed beam components being pivotably connected with each other by a hinge shaft disposed on end portions of the first beam and the second beam; a groove extending along a lengthwise direction of the bottom block components being formed in a top surface of the bottom block components; the hinge shaft extending into the groove; end hinge shafts being disposed on free ends of both the first beam and the second beam in crossed beam components at two opposite sides of the composite pallet, the end hinge shaft pivotally connecting the first beam and the second beam to free ends of the bottom block components.

3. The composite pallet of claim 2, further comprising a middle bottom block of a hollow structure, a connected long groove and a plurality of third through holes being formed in a top surface of the middle bottom block, a bottom end of the middle hinge shaft being a stub caption, the middle hinge shaft being capable of sliding in the long groove after the bottom end of the middle hinge shaft passing through the third through holes.

4. The composite pallet of claim 1, wherein one of the first cantilever and the second cantilever comprises a sliding pillar protruded from thereof, and the another one of the first cantilever and the second cantilever defines a bar-shaped opening extending along the lengthwise direction of the cantilevers and a first through hole in the middle of the bar-shaped opening, a stub end of the sliding pillar having a diameter less than that of the first through hole and greater than the width of the bar-shaped opening, the sliding pillar being capable of sliding in the bar-shaped opening after being inserted into the first through hole.

5. The composite pallet of claim 1, wherein each of the bottom block components comprises one first bottom block, end portions of the first bottom block in the two bottom block components being fixed to two ends of one of the cantilever components, respectively, end portions of the second bottom block in the two bottom block components being fixed to two ends of another one of the cantilever components.

6. The composite pallet of claim 5, wherein the second bottom block has a hollow cylindrical structure and the first bottom blocks being inserted into the second bottom block.

7. The composite pallet of claim 6, wherein at least one sidewall of the first bottom block comprises an elastic protrusion, and at least one sidewall of the second bottom block comprises a latching hole for latching the elastic protrusion; during the first bottom block sliding relative to the second bottom block, the elastic protrusion is selectively latched into or rejected from the latching hole.

8. The composite pallet of claim 7, wherein the first bottom block is a hollow structure, and comprises an elastic plate and a second through hole for allowing the elastic protrusion to pass through, one end of the elastic plate being fixed on an inner wall of the first bottom block, the elastic protrusion being formed on an free end of the elastic plate.

9. The composite pallet of claim 1, wherein each of the bottom block components comprises two first bottom blocks disposed at two opposite ends of a corresponding second bottom block; two ends of the cantilever components being fixed to end portions of said two first bottom blocks, respectively.

10. The composite pallet of claim 9, wherein the second bottom block is a hollow cylindrical structure, and the first bottom block is inserted into the second bottom block.

11. The composite pallet of claim 10, wherein at least one sidewall of the first bottom block comprises an elastic protrusion, and at least one sidewall of the second bottom block comprises a latching hole for latching the elastic protrusion; during the first bottom block sliding relative to the second bottom block, the elastic protrusion is selectively latched into or rejected from the latching hole.

12. The composite pallet of claim 11, wherein the first bottom block is a hollow structure, and comprises an elastic plate and a second through hole for allowing the elastic protrusion to pass through, one end of the elastic plate being fixed on an inner wall of the first bottom block, the elastic protrusion being formed on an free end of the elastic plate.

13. A composite pallet comprising:

two parallel bottom block components, each of the bottom block components comprising a first bottom block and a second bottom block slidably connected with the first bottom block, the first bottom block being capable of sliding relative to the second bottom block to vary the length of the bottom block components;

two cantilever components, each of the two cantilever components comprising a first cantilever and a second cantilever slidably connected with the first cantilever, the first cantilever and the second cantilever each being fixed to a corresponding one of the bottom block components, the first cantilever being capable of sliding relative to the second cantilever along a lengthwise direction of the cantilever components to vary the length of the cantilever components;

wherein the second bottom block has a hollow cylindrical structure and the first bottom blocks being inserted into the second bottom block;

wherein at least one sidewall of the first bottom block comprises an elastic protrusion, and at least one sidewall of the second bottom block comprises a latching hole for latching the elastic protrusion; during the first bottom block sliding relative to the second bottom block, the elastic protrusion is selectively latched into or rejected from the latching hole.

14. The composite pallet of claim 13, wherein the first bottom block is a hollow structure, and comprises an elastic plate and a second through hole for allowing the elastic protrusion to pass through, one end of the elastic plate being fixed on an inner wall of the first bottom block, the elastic protrusion being formed on an free end of the elastic plate.

* * * * *